US009739233B2

(12) United States Patent
Funahashi et al.

(10) Patent No.: US 9,739,233 B2
(45) Date of Patent: Aug. 22, 2017

(54) PISTON OF INTERNAL COMBUSTION ENGINE

(71) Applicant: HITACHI AUTOMOTIVE SYSTEMS, LTD., Hitachinaka-shi, Ibaraki (JP)

(72) Inventors: Toshiyuki Funahashi, Zama (JP); Takashi Ide, Atsugi (JP); Toshiro Fushimi, Atsugi (JP)

(73) Assignee: HITACHI AUTOMOTIVE SYSTEMS, LTD., Hitachinaka-Shi (JP)

( * ) Notice: Subject to any disclaimer, the term of this patent is extended or adjusted under 35 U.S.C. 154(b) by 33 days.

(21) Appl. No.: 14/579,325

(22) Filed: Dec. 22, 2014

(65) Prior Publication Data

US 2015/0198112 A1 Jul. 16, 2015

(30) Foreign Application Priority Data

Jan. 16, 2014 (JP) ..... 2014-005524

(51) Int. Cl.

| | |
|---|---|
| ***F02F 3/00*** | (2006.01) |
| ***F02F 3/02*** | (2006.01) |
| *F02F 3/22* | (2006.01) |
| *F02B 3/06* | (2006.01) |

(52) U.S. Cl.

CPC ..... *F02F 3/0069* (2013.01); *F02F 3/02* (2013.01); *F02B 3/06* (2013.01); *F02F 3/00* (2013.01); *F02F 3/0076* (2013.01); *F02F 3/22* (2013.01); *F05C 2201/021* (2013.01); *F05C 2201/0448* (2013.01)

(58) Field of Classification Search

CPC ..... F05C 2201/021; F05C 2201/0448; F02F 3/22; F02F 3/00; F02B 3/06

USPC ..... 123/193.6

See application file for complete search history.

(56) References Cited

U.S. PATENT DOCUMENTS

| | | | | |
|---|---|---|---|---|
| 1,727,647 | A | 9/1929 | Jardine | |
| 7,954,421 | B2 | 6/2011 | Buschbeck et al. | |
| 2003/0051694 | A1* | 3/2003 | Gaiser | F02F 3/003 123/193.6 |

FOREIGN PATENT DOCUMENTS

| | | | |
|---|---|---|---|
| JP | 2003-161204 | A | 6/2003 |
| JP | 2006-057481 | A | 3/2006 |
| JP | 2009-506259 | A | 2/2009 |
| JP | 2011-132809 | A | 7/2011 |

* cited by examiner

*Primary Examiner* — Hung Q Nguyen
*Assistant Examiner* — Charles Brauch
(74) *Attorney, Agent, or Firm* — Foley & Lardner LLP

(57) ABSTRACT

A piston of an internal combustion engine includes a crown portion; a pair of thrust-side and counter-thrust-side skirt portions; and a pair of apron portions connecting the thrust-side skirt portion with the counter-thrust-side skirt portion. Each of the pair of apron portions includes an upper end wall connected with the crown portion, and a pin boss portion supporting a piston pin. A reverse-surface-side portion of the crown portion is formed with a hollow portion extending along an outer surface of the upper end wall of the apron portion. The upper end wall of the apron portion includes a bending portion between an outside surface of the pin boss portion and a circumferential end of the skirt portion. The bending portion bends in a step-like manner from the outside surface of the pin boss portion toward the circumferential end of the skirt portion.

6 Claims, 11 Drawing Sheets

PISTON OF INTERNAL COMBUSTION ENGINE

BACKGROUND OF THE INVENTION

The present invention relates to a piston of internal combustion engine.

Japanese Patent Application Publication No. 2011-132809 (hereinafter, referred to as patent document 1) discloses a previously-proposed piston of internal combustion engine.

In this technique, the piston is integrally formed of aluminum alloy. This piston includes a pair of thrust-side and counter-thrust-side skirt portions, a pair of apron portions, and a crown portion on which a combustion chamber is defined. The pair of thrust-side and counter-thrust-side skirt portions are integrally formed with the crown portion. Each of the pair of thrust-side and counter-thrust-side skirt portions slides on a surface of cylinder wall and is formed in an arc shape in cross section. The pair of apron portions are respectively connected with circumferential both ends of the pair of skirt portions, and include pin boss portions. A concave portion is formed inside an upper end portion of the apron portion, and moreover, a necking portion (waisted portion) is provided at a lower portion of the concave portion. By this necking portion, a stiffness of at least a crown-portion-side part of the skirt portion is reduced for the purpose of suppressing an intensive contact between the cylinder wall and the crown-portion-side part of the skirt portion so as to reduce a friction.

SUMMARY OF THE INVENTION

However, in the technique disclosed by the patent document 1, a span between the opposed apron portions becomes larger as a location is shifted from the necking portion in an upper direction of the skirt portion because the necking portion is provided to the apron portion. Hence, a base end portion of the apron portion which is near a reverse surface of the crown portion is not sufficiently reduced in thickness (volume) although the stiffness of the crown-portion-side part of the skirt portion can be reduced. As a result, there is a risk that a weight of the piston cannot be sufficiently reduced.

Moreover, because the volume of the base end portion of the apron portion is relatively large, the stiffness of (crown-portion side of) a connection spot between the apron portion and the skirt portion is inhibited from being reduced, so that a contact surface pressure of the skirt portion against the cylinder wall is not sufficiently reduced near the crown portion. As a result, the friction between the cylinder wall surface and the skirt portion is not sufficiently reduced.

It is therefore an object of the present invention to provide a piston of an internal combustion engine, devised to reduce the friction in addition to the weight reduction of the piston.

According to one aspect of the present invention, there is provided a piston of an internal combustion engine, comprising: a crown portion including a crown surface on which a combustion chamber is formed; a pair of thrust-side and counter-thrust-side skirt portions each of which is formed integrally with a reverse-surface-side portion of the crown portion and formed in an arc shape in cross section, the thrust-side and counter-thrust-side skirt portions being configured to slide on a wall surface of a cylinder; and a pair of apron portions connecting circumferential both ends of the thrust-side skirt portion with circumferential both ends of the counter-thrust-side skirt portion, the pair of apron portions each including an upper end wall connected with the reverse-surface-side portion of the crown portion, and a pin boss portion supporting an end portion of a piston pin, wherein the reverse-surface-side portion of the crown portion is formed with a hollow portion extending along an outer surface of the upper end wall, the upper end wall of each of the pair of apron portions includes a bending portion between an outside surface of the pin boss portion and one of the circumferential both ends of the thrust-side and counter-thrust-side skirt portions, and the bending portion bends in a step-like manner from the outside surface of the pin boss portion toward the one of the circumferential both ends of the thrust-side and counter-thrust-side skirt portions.

According to another aspect of the present invention, there is provided a piston of an internal combustion engine, comprising: a crown portion including a crown surface on which a combustion chamber is formed; a pair of thrust-side and counter-thrust-side skirt portions each of which is integrally connected with a reverse-surface-side portion of the crown portion and formed in an arc shape in cross section, the thrust-side and counter-thrust-side skirt portions being configured to slide on a wall surface of a cylinder; and a pair of apron portions integrally connected with the reverse-surface-side portion of the crown portion and connected with circumferential both ends of the thrust-side and counter-thrust-side skirt portions, the pair of apron portions each including a pin boss portion, wherein the reverse-surface-side portion connected with upper end walls of the pair of apron portions is formed with a first concave portion exposed to an outer surface of the upper end wall, the upper end wall of each of the pair of apron portions is located inside of the first concave portion and includes first slant portions extending from both side surfaces of the pin boss portion along a line perpendicular to an axis of the pin boss portions, and extending from a lower end wall of the corresponding apron portion in an axially upper direction of the piston so as to slant in a radially inner direction of the piston, second slant portions connected with the circumferential ends of the thrust-side and counter-thrust-side skirt portions and extending from the lower end wall in the axially upper direction of the piston so as to slant in a radially outer direction of the piston, and connecting portions connecting the first slant portions with the second slant portions, wherein an outer surface of the pin boss portion cooperates with an outer surface of the first slant portion and an outer surface of the connecting portion to form a second concave portion exposed to the first concave portion.

The other objects and features of this invention will become understood from the following description with reference to the accompanying drawings.

DETAILED DESCRIPTION OF THE INVENTION

Figure 1:
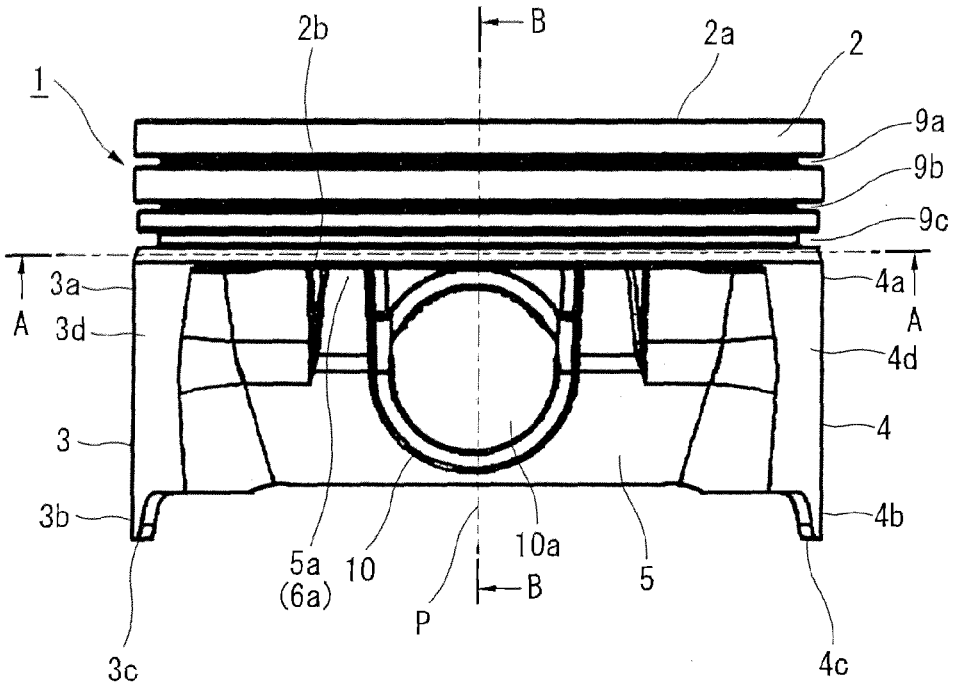
FIG. 1 is a front view of a piston of an internal combustion engine in a first embodiment according to the present invention.

Hereinafter, embodiments of a piston of internal combustion engine according to the present invention will be explained in detail referring to the drawings. In the following embodiments, the piston is applied to an in-line four-cylinder gasoline engine which includes two intake valves and two exhaust valves per one cylinder.

First Embodiment

The piston 1 is provided in a cylinder formed in a cylinder block (not shown). The cylinder is formed in a substantially circular-column shape. The piston 1 is slidable on a wall surface of the cylinder, and thereby forms a combustion chamber between a cylinder head and the wall surface of the cylinder. The piston 1 is connected to a crankshaft through a con-rod (connecting rod) which is connected with a piston pin.

Figure 4:
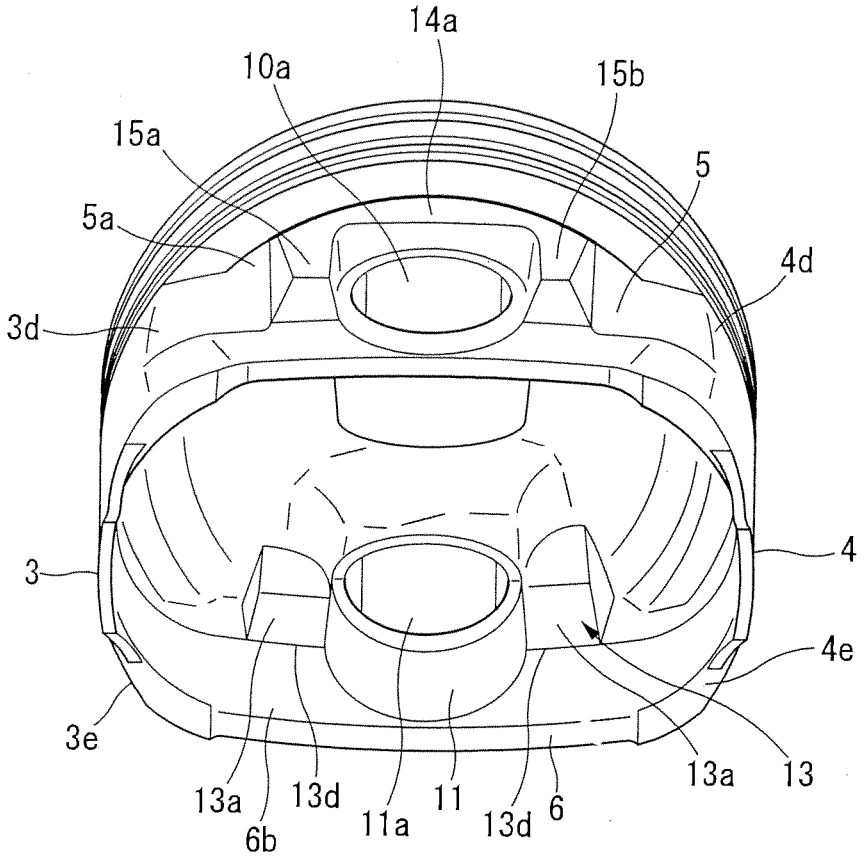
FIG. 4 is an oblique perspective view of the piston in the first embodiment, as viewed from a bottom side of the piston.
Figure 5:
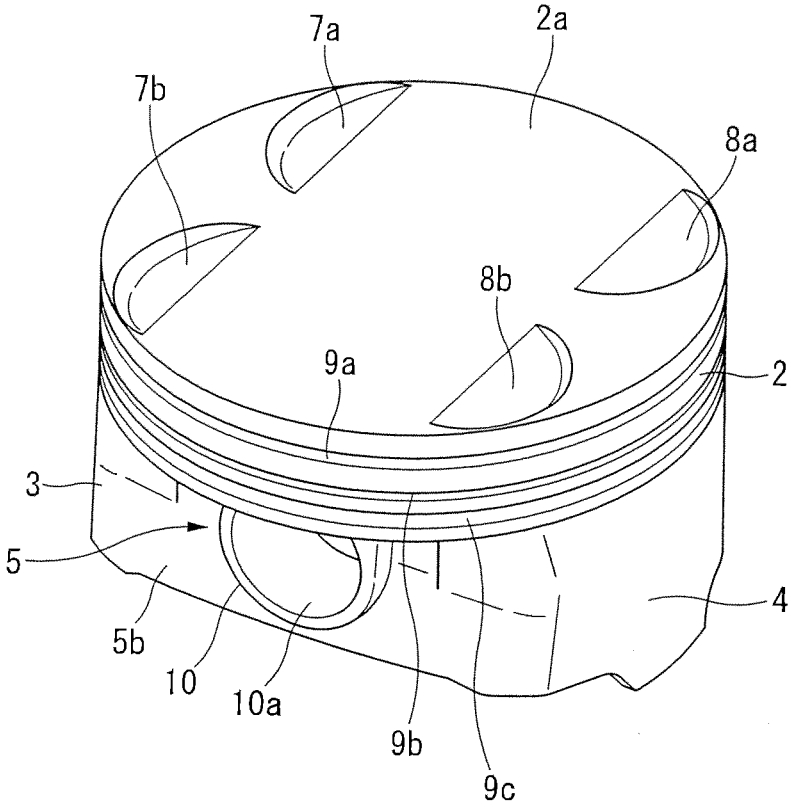
FIG. 5 is an oblique perspective view of the piston, as viewed from a crown-portion side of the piston.

Whole of the piston 1 is integrally molded by Al—Si-series aluminum alloy in AC8A (JIS: Japanese Industrial Standards). As shown in FIGS. 1, 4 and 5, whole of the piston 1 is formed approximately in a circularly cylindrical shape. The piston 1 includes a crown portion 2, a pair of thrust-side skirt portion 3 and counter-thrust-side skirt portion 4, and a pair of apron portions 5 and 6. The crown portion 2 includes a crown surface 2*a* on which the combustion chamber is defined. The pair of thrust-side skirt portion 3 and counter-thrust-side skirt portion 4 are integrally provided on (i.e., integrally formed with) an outer circumferential edge of a lower end of the crown portion 2. Each of the pair of thrust-side skirt portion 3 and counter-thrust-side skirt portion 4 is formed in a circular-arc shape in cross section. The pair of apron portions 5 and 6 are respectively connected with circumferential both ends 3*d*, 4*d*, 3*e*, 4*e* of the pair of skirt portions 3 and 4.

The crown portion 2 is formed to be relatively thick and formed in a disc shape. Valve recesses 7*a*, 7*b*, 8*a*, 8*b* are formed in the crown surface 2*a* of the crown portion 2. Each of the valve recesses 7*a*, 7*b*, 8*a*, 8*b* functions to prevent an interference with the intake or exhaust valve. Three ring grooves 9*a*, 9*b*, 9*c* are formed in an outer circumferential portion of the crown portion 2. The three ring grooves 9*a*, 9*b*, 9*c* hold three piston rings such as a pressure ring and an oil ring.

As shown in FIGS. 1 and 4, the both skirt portions 3 and 4 are left-right symmetric with respect to an axis P (a center line parallel to a piston moving direction) of the piston 1, and are shaped like arc in cross section. In other words, the both skirt portions 3 and 4 are formed to be opposed to each other in a radial direction of the piston 1. Almost whole of the both skirt portions 3 and 4 is formed to be relatively thin. When the piston 1 moves toward its bottom dead center at the time of expansion stroke and the like, the thrust-side skirt portion 3 is inclined to the cylinder wall-surface to become in press-contact with the cylinder wall-surface in relation to an angle of the con-rod. On the other hand, when the piston 1 rises at the time of compression stroke and the like, the counter-thrust-side skirt portion 4 is inclined to the cylinder wall-surface to become in press-contact with the cylinder wall-surface in a counter direction. A load of this press contact of the thrust-side skirt portion 3 against the cylinder wall-surface is larger than that of the counter-thrust-side skirt portion 4 against the cylinder wall-surface because the thrust-side skirt portion 3 presses the cylinder wall surface by receiving a combustion pressure.

Figure 6:
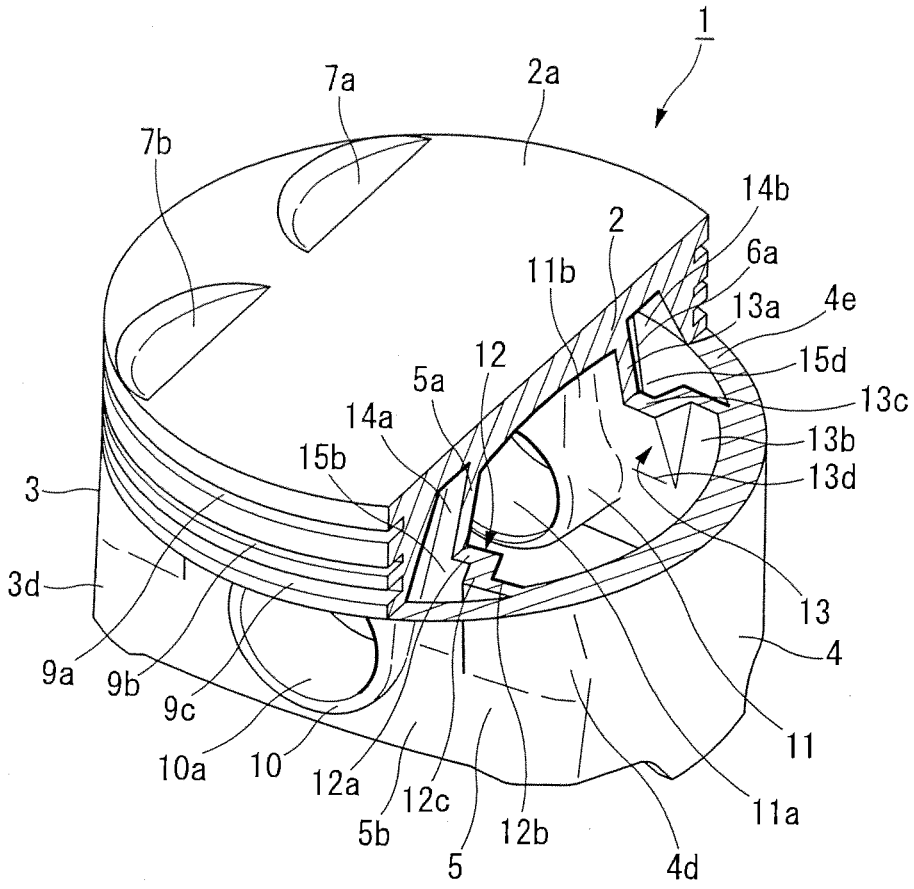
FIG. 6 is an oblique perspective view of the piston under the state that a part of crown-portion's side of the piston is imaginarily cut.
Figure 7:
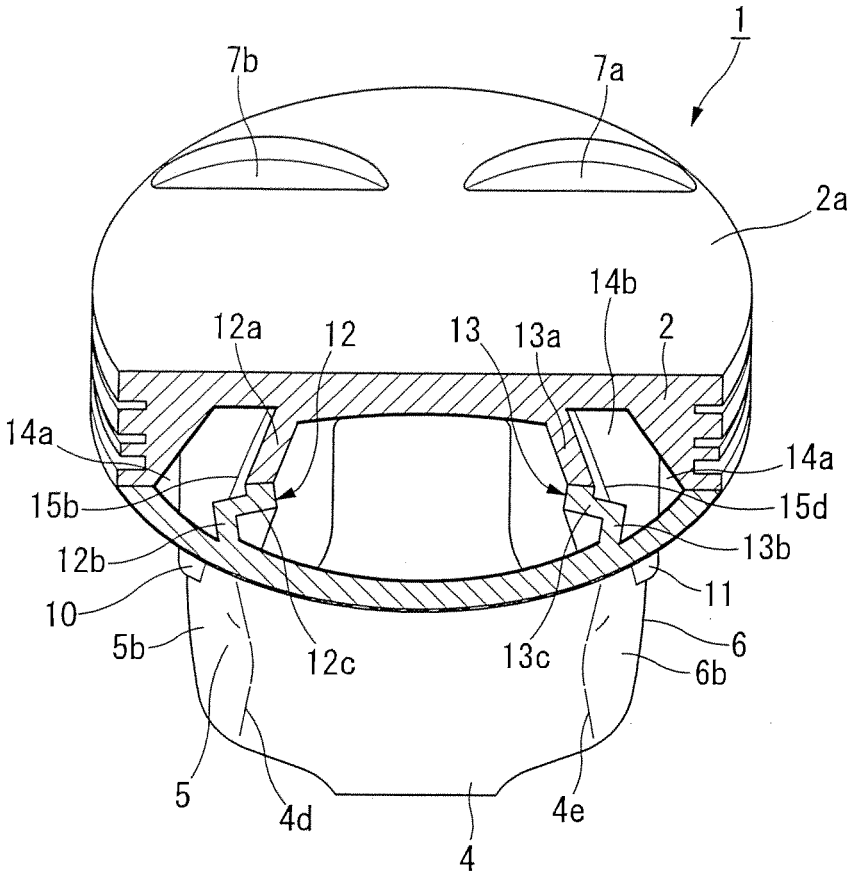
FIG. 7 is an oblique perspective view of the piston under the state that a part of crown-portion's side of the piston is imaginarily cut, as viewed from a skirt portion side of the piston (as viewed in a lateral direction of the piston).

Each of the skirt portions 3 and 4 includes an upper end portion 3*a*, 4*a* located adjacent to the crown portion 2 and a lower end portion 3*b*, 4*b*. As shown in FIGS. 4, 6 and 7, each of the skirt portions 3 and 4 is formed such that a radius of the skirt portion 3, 4 (i.e., a distance to the piston axis) is slightly enlarged over a range from the upper end portion 3*a*, 4*a* to the lower end portion 3*b*, 4*b*. That is, the skirt portions 3 and 4 are slightly slanted to form an inverted-V shape in vertical section (parallel to the piston moving direction). A lower edge 3*c*, 4*c* of each of the skirt portions 3 and 4 is formed to be cut in a substantially horizontal direction (perpendicular to the piston moving direction).

As shown in FIGS. 1, 4, 8 and 9, an upper end wall 5*a*, 6*a* of each of the apron portions 5 and 6 is integrally combined (integrally formed) with a lower end portion 2*b* of the crown portion 2. Circumferentially whole of the apron portion 5, 6 except a part of the upper end wall 5*a*, 6*a* is curved at a curvature radius larger than that of the skirt portion 3, 4 so as to bulge outwardly to a small extent. Moreover, in the same manner as the skirt portion 3, 4, the apron portion 5, 6 is formed such that a radius (diameter) of the apron portion 5, 6 is gradually enlarged over a range from the upper end wall 5*a*, 6*a* to a lower end portion 5*b*, 6*b* of the apron portion 5, 6 along the axial direction of the piston 1. That is, the apron portions 5 and 6 are slanted to form an inverted-V shape in vertical section.

A first lightening portion (hollow portion) 14*a* is formed in a reverse side of the crown portion 2, at a combined portion between the lower end portion 2*b* and the upper end wall 5*a* of the apron portion 5. The first lightening portion 14*a* is formed along an external surface of the upper end wall 5*a* of the apron portion 5.

In the same manner, a first lightening portion (hollow portion) 14*b* is formed in the reverse side of the crown portion 2, at a combined portion between the lower end portion 2*b* and the upper end wall 6*a* of the apron portion 6. The first lightening portion 14*b* is formed along an external surface of the upper end wall 6*a*. Each of the first lightening portions 14*a* and 14*b* is a first recess (concave portion) and is substantially in a circular-arc shape in cross section.

The apron portion 5 includes a pin boss portion 10 substantially at a center of the apron portion 5 with respect to a circumferential direction of the apron portion 5. In the same manner, the apron portion 6 includes a pin boss portion 11 substantially at a center of the apron portion 6 with respect to a circumferential direction of the apron portion 6. Each of the pin boss portions 10 and 11 is formed in a circular-tube shape. The pair of pin boss portions 10 and 11 support both end portions of the piston pin through pin holes 10*a* and 11*a*.

Figure 2:
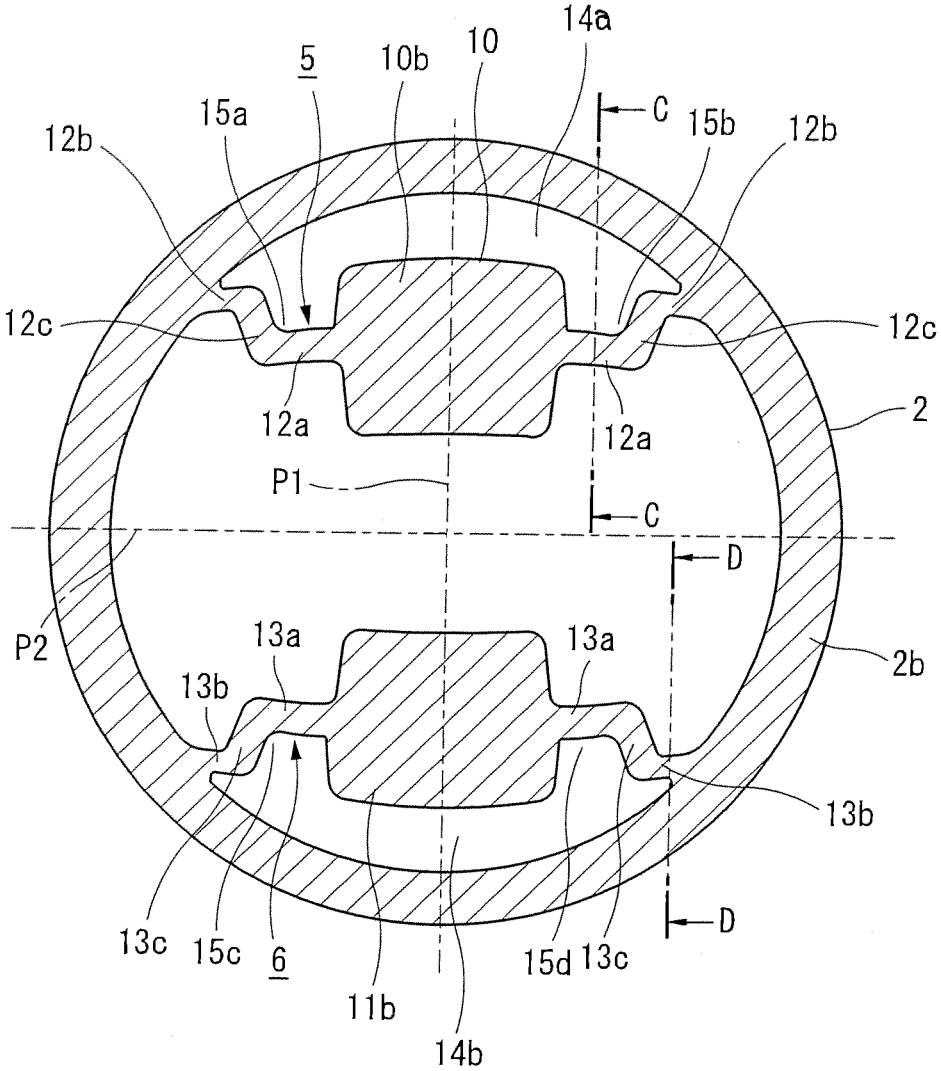
FIG. 2 is a cross-sectional view of FIG. 1, taken along a line A-A.
Figure 3:
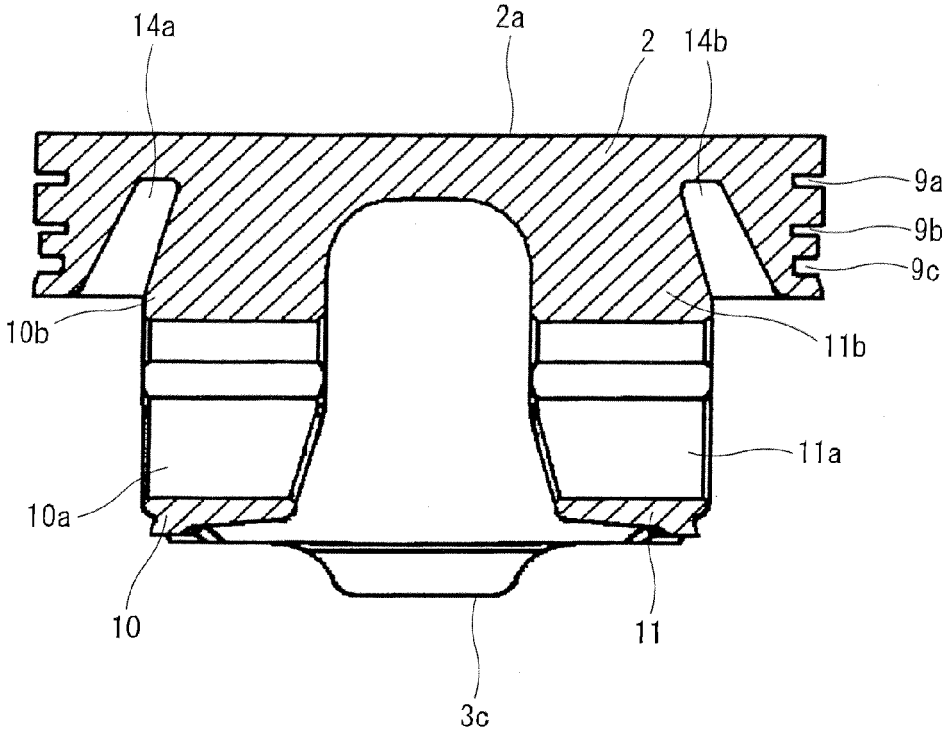
FIG. 3 is a vertically-sectional view of FIG. 1, taken along a line B-B.

As shown in FIGS. 2, 6 and 7, the apron portion 5 includes bending portions 12, and in the same manner, the apron portion 6 includes bending portions 13. Each bending portion 12, 13 is constructed by bending a part of the upper end wall 5*a*, 6*a* in a crank shape.

Specifically, as shown in FIG. 2, the bending portions 12 are provided symmetrically with respect to an axis P1 of both the pin boss portions 10 and 11. That is, the two bending portions 12 form a left-right symmetry with respect to the axis P1, as viewed in the axial direction of the piston 1. In the same manner, the bending portions 13 are provided symmetrically with respect to the axis P1 of both the pin boss portions 10 and 11. That is, the two bending portions 13 form a left-right symmetry with respect to the axis P1, as viewed in the axial direction of the piston 1. Moreover, as shown in FIG. 2, the bending portion 12 and the bending portion 13 are symmetrical with respect to an intersection line P2 which is perpendicular to the axis P1 of both the pin boss portions 10 and 11. That is, the two bending portions 12 and the two bending portions 13 form a left-right symmetry with respect to the intersection line P2, as viewed in the axial direction of the piston 1. The two bending portions 12 are formed over a range from both edges of an upper wall 10*b* of the pin boss portion 10 to both ends 3*d* and 4*d* of the skirt portions 3 and 4. In this range, each of the bending portions 12 is bent in a crank shape expanded in a step-like manner (i.e., such that an inner space of the piston 1 is enlarged). In the same manner, the two bending portions 13 are formed over a range from both edges of an upper wall 11*b* of the pin boss portion 11 to both ends 3*e* and 4*e* of the skirt portions 3 and 4. In this range, each of the bending portions 13 is bent in a crank shape expanded in a step-like manner.

Each of the bending portions 12 includes a base end portion 12*a* which is a first slant portion; a tip portion 12*b* which is a second slant portion; and a connecting portion 12*c*. One-side ends of the base end portions 12*a* are respectively bound to (formed integrally with) both surfaces of the upper wall 10*b* of the pin boss portion 10. One-side ends of the tip portions 12*b* are respectively bound to (formed integrally with) the ends 3*d* and 4*d* of the skirt portions 3 and 4. The connecting portion 12*c* is provided between the base end portion 12*a* and the tip portion 12*b*, and connects another-side end of the base end portion 12*a* with another-side end of the tip portion 12*b*. In the same manner, each of the bending portions 13 includes a base end portion 13*a* which is the first slant portion; a tip portion 13*b* which is the second slant portion; and a connecting portion 13*c*. One-side ends of the base end portions 13*a* are respectively bound to (formed integrally with) both surfaces of the upper wall 11*b* of the pin boss portion 11. One-side ends of the tip portions 13*b* are respectively bound to (formed integrally with) the ends 3*e* and 4*e* of the skirt portions 3 and 4. The connecting portion 13*c* connects another-side end of the base end portion 13*a* with another-side end of the tip portion 13*b*.

As shown in FIG. 6, each bending portion 12, 13 extends from a lower surface of the crown portion 2 to a location slightly lower than a center of the apron portion 5, 6, in a slanted manner with respect to the axial direction of the piston 1. A lower end edge 12*d*, 13*d* of the bending portion 12, 13 is continuously connected with (smoothly bound to) an upper edge of the lower end portion 5*b*, 6*b*. This gives a length of the bending portion 12, 13 with respect to the axial direction of the piston 1.

Figure 8:
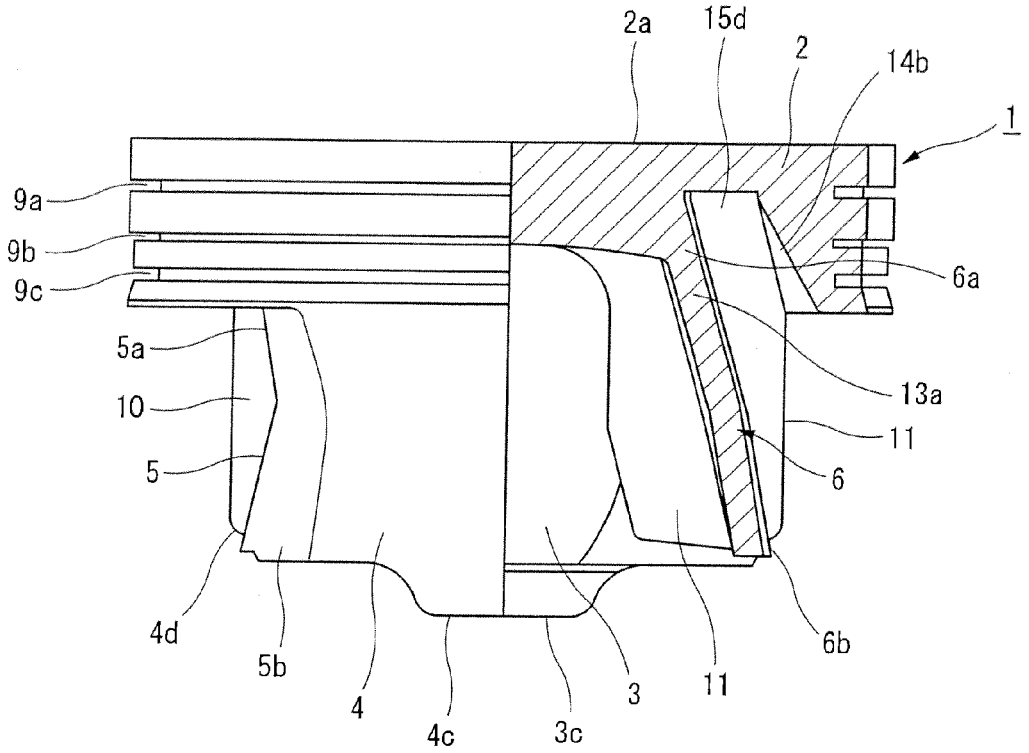
FIG. 8 is a vertically-sectional view of FIG. 2, taken along a line C-C.

As shown in FIG. 2, each base end portion 12*a*, 13*a* extends substantially perpendicular to the axis P1 of both the pin boss portions 10 and 11, at a radially inner side of the piston 1 beyond the first lightening portion 14*a*, 14*b*. Moreover, as shown in FIG. 8, the base end portion 12*a*, 13*a* is formed at a location advanced more in a radially inner direction of the piston 1 as the location becomes closer to an uppermost portion of the base end portion 12*a*, 13*a* (i.e., becomes closer to the crown surface 2*a*). That is, the base end portion 12*a*, 13*a* extends from the upper edge of the lower end portion 5*b*, 6*b* in an axially upper direction of the piston 1 so as to be slightly inclined or curved in the radially inner direction of the piston 1.

Figure 9:
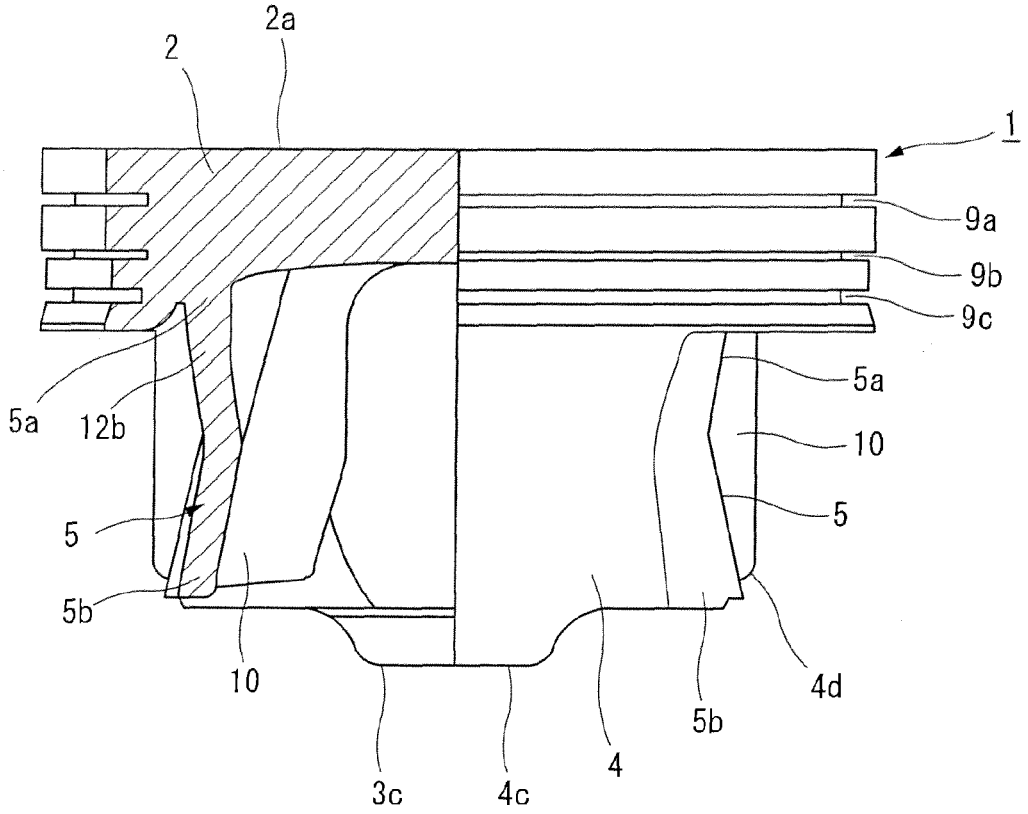
FIG. 9 is a vertically-sectional view of FIG. 2, taken along a line D-D.

The tip portion 12*b*, 13*b* is located at a radially outer side beyond the base end portion 12*a*, 13*a*. The tip portion 12*b*, 13*b* extends substantially perpendicular to the axis P1. Moreover, as shown in FIG. 9, the tip portion 12*b*, 13*b* is formed at a location advanced more in a radially outer direction of the piston 1 as the location becomes closer to an uppermost portion of the tip portion 12*b*, 13*b* (i.e., becomes closer to the crown surface 2*a*). That is, the tip portion 12*b*, 13*b* extends from the upper edge of the lower end portion 5*b*, 6*b* in the axially upper direction of the piston 1 so as to be slightly inclined or curved in the radially outer direction of the piston 1, over a range from the one-side end of the tip portion 12*b*, 13*b* to the another-side end of the tip portion 12*b*, 13*b*.

Each connecting portion 12*c*, 13*c* includes one-side end connected with the another-side end of the base end portion 12*a*, 13*a*, and another-side end connected with the another-side end of the tip portion 12*b*, 13*b*. The connecting portion 12*c*, 13*c* extends in the radially outer direction of the piston 1 from the one-side end to the another-side end thereof. The connecting portion 12*c*, 13*c* extends or slants outwardly with respect to the axis P1 of both the pin boss portions 10 and 11 over a range from the one-side end to the another-side end of the connecting portion 12*c*, 13*c*. In other words, a distance between the axis P1 and the connecting portion 12*c*, 13*c* gradually becomes larger from the one-side end of the connecting portion 12*c*, 13*c* to the another-side end of the connecting portion 12*c*, 13*c*.

Because each bending portion 12, 13 is bent in a step-like crank shape, four second lightening portions (hollow portions) 15*a*, 15*b*, 15*c* and 15*d* are formed on radially-outer surfaces of the base end portions 12*a*, 13*a* as shown in FIGS. 2 and 8. Each of the second lightening portions 15*a*-15*d* is a second recess (concave portion) and is exposed to (i.e., open to) the first lightening portion 14*a*, 14*b*.

Each of the second lightening portions 15*a*-15*d* is surrounded (defined) by the radially-outer surface of the base end portion 12*a*, 13*a*, the connecting portion 12*c*, 13*c* and a lateral surface of the pin boss portion 10, 11. Thereby, each of the second lightening portions 15*a*-15*d* is formed in a substantially rectangular shape in cross section. Moreover, as shown in FIG. 8, a cross-sectional area of each of the second lightening portions 15*a*-15*d* becomes gradually smaller from its upper end side toward its lower end, along the slant shape of the base end portion 12*a*, 13*a*.

As shown in FIG. 2, a connection spot between the base end portion 12*a*, 13*a* and the connecting portion 12*c*, 13*c* has a chamfered outer surface formed in an arc shape in cross section. In the same manner, a connection spot between the connecting portion 12*c*, 13*c* and the tip portion 12*b*, 13*b* has a chamfered outer surface formed in an arc shape in cross section.

In this embodiment, a thickness of the base end portion 12*a*, 13*a* is approximately equal to a thickness of the connecting portion 12*c*, 13*c*. A thickness of the tip portion 12*b*, 13*b* is smaller than those of the base end portion 12*a*, 13*a* and the connecting portion 12*c*, 13*c*.

Operations and Effects According to Embodiments

According to this embodiment, since a part of the upper end wall 5*a*, 6*a* of the apron portion 5, 6 is formed as the bending portion 12, 13 bent in the crank shape, the second lightening portions 15*a*-15*d* are formed in the concave shapes given on the base end portions 12*a*, 13*a* in addition to the first lightening portions 14*a*, 14*b*. Hence, whole of the piston 1 can be lightened in weight. In particular, the second lightening portions 15*a*-15*d* are formed such that a body (crown portion) of the piston 1 is largely cut toward the axis P. That is, the second lightening portions 15*a*-15*d* exist to largely extend in the radially inner direction of the piston 1. Therefore, the weight reduction of the piston 1 is further promoted.

The first lightening portions 14*a*, 14*b* and the second lightening portions 15*a*-15*d* are not formed at locations that affect a strength of the crown portion 2. Hence, the crown portion 2 is not deflected (deformed) in its lower direction due to combustion pressure.

Since the bending portion 12, 13 is formed in the crank shape, a portion of the skirt portion 3, 4 which is near the crown portion 2 has a low support-stiffness as compared with, for example, the case that the upper end wall of the apron portion is formed in a liner shape as the above-mentioned earlier technology. Hence, when a contact between the wall surface of the cylinder and an outer circumferential surface of the skirt portion 3, 4 causes a thrust-side load and a counter-thrust-side load by the reciprocating strokes of the piston 1, a contact surface pressure between the wall surface of the cylinder and the upper end portion 3*a*, 4*a* of the skirt portion 3, 4 which is near the crown portion 2 can be reduced.

That is, the bending portion 12, 13 slightly causes a deflection (flexion deformation) about the connecting portion 12*c*, 13*c* toward the pin boss portion 11, 12 in a manner of accordion when a load greater than or equal to a predetermined level is applied from the skirt portion 3, 4 in a width direction (the lateral direction) of the bending portion 12, 13. Thereby, the thrust-side load and the counter-thrust-side load are absorbed by the bending portion 12, 13, so that the contact surface pressure which acts on the upper end portion 3*a*, 4*a* (near the crown portion 2) can be reduced. As a result, a friction between the upper end portion 3*a*, 4*a* and the wall surface of the cylinder can be effectively reduced.

Figure 10:
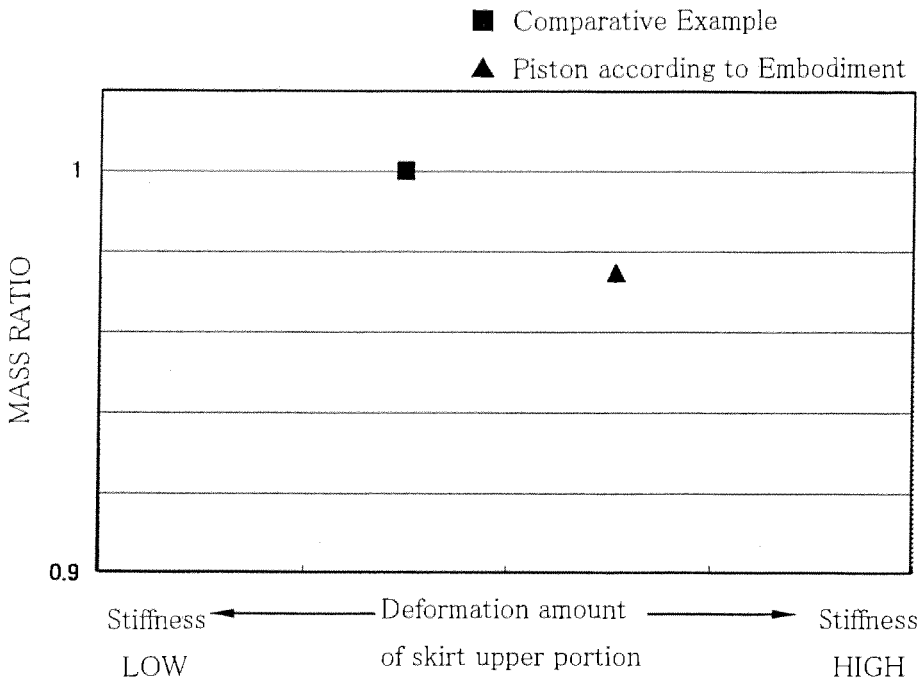
FIG. 10 is a graph illustrating a mass ratio between the piston of the first embodiment and a piston of earlier technology, and illustrating a comparison between the piston of the first embodiment and the piston of earlier technology in a deformation amount of an upper end portion of the skirt portion which is calculated by numerical analysis under an identical load condition.

A graph of FIG. 10 shows a mass ratio between the piston 1 according to this embodiment and the piston of the above-mentioned earlier technology, and a comparison in a deformation amount (deflection amount) of the upper end portion of the skirt portion between the piston 1 according to this embodiment and the piston of the above-mentioned earlier technology. These deformation amounts were calculated by numerical analysis under an identical load condition.

As shown in FIG. 10, the piston 1 according to this embodiment has a piston mass lower by about 3 percent (%) than that of the piston of the above-mentioned earlier technology. Accordingly, it can be understood that the piston 1 according to this embodiment is sufficiently reduced in weight. This weight reduction is attained particularly by a contribution of the formation of second lightening portions 15*a*-15*d*.

Moreover, in the piston 1 according to this embodiment, the upper end portion 3*a* of the skirt portion 3 has the deformation amount (deflection amount) larger than that of the piston of the above-mentioned earlier technology. It is clear that the stiffness of the upper end portion 3*a* of the skirt portion 3 is lower than that of the piston of the above-mentioned earlier technology.

That is, the piston 1 according to this embodiment can achieve light weight as compared with the piston of the above-mentioned earlier technology, by providing the second lightening portions 15*a*-15*d* which are formed by the bending portions 12 and 13. Moreover, the contact surface pressure between the wall surface of the cylinder and the upper end portion 3*a*, 4*a* of the skirt portion 3, 4 which is near the crown portion 2 can be reduced by means of effective flexion deformation (flexible deformation) which is generated based on the peculiar shapes of the bending portions 12 and 13.

Moreover, in the piston 1 according to this embodiment, as shown in FIG. 8, each of the base end portions 12*a* and 13*a* slants such that its axially upper side (i.e. crown-surface side) is advanced in the radially inner direction of the piston 1. On the other hand, as shown in FIG. 9, each of the tip portion 12*b*, 13*b* slants such that its axially upper side (i.e. crown-surface side) is advanced in the radially outer direction of the piston 1. Hence, the bending portions 12 and 13 are easily deflected (flexibly deformed) by the load inputted from the skirt portions 3 and 4. Accordingly, an absorption property for this input load is favorable so that the contact surface pressure to the wall surface of the cylinder is further reduced. As a result, the friction can be favorably reduced.

Moreover, each of both ends of the connecting portion 12*c*, 13*c* has the connection spot whose outer surface is formed in the arc shape in cross section. Hence, at the time of deflection (flexible deformation) of the bending portion 12, 13, a stress concentration at the connection spot of the connecting portion 12*c*, 13*c* can be avoided. Accordingly, crack, rupture and the like at this connection spot can be sufficiently inhibited from occurring, so that a durability is improved.

Figure 11:
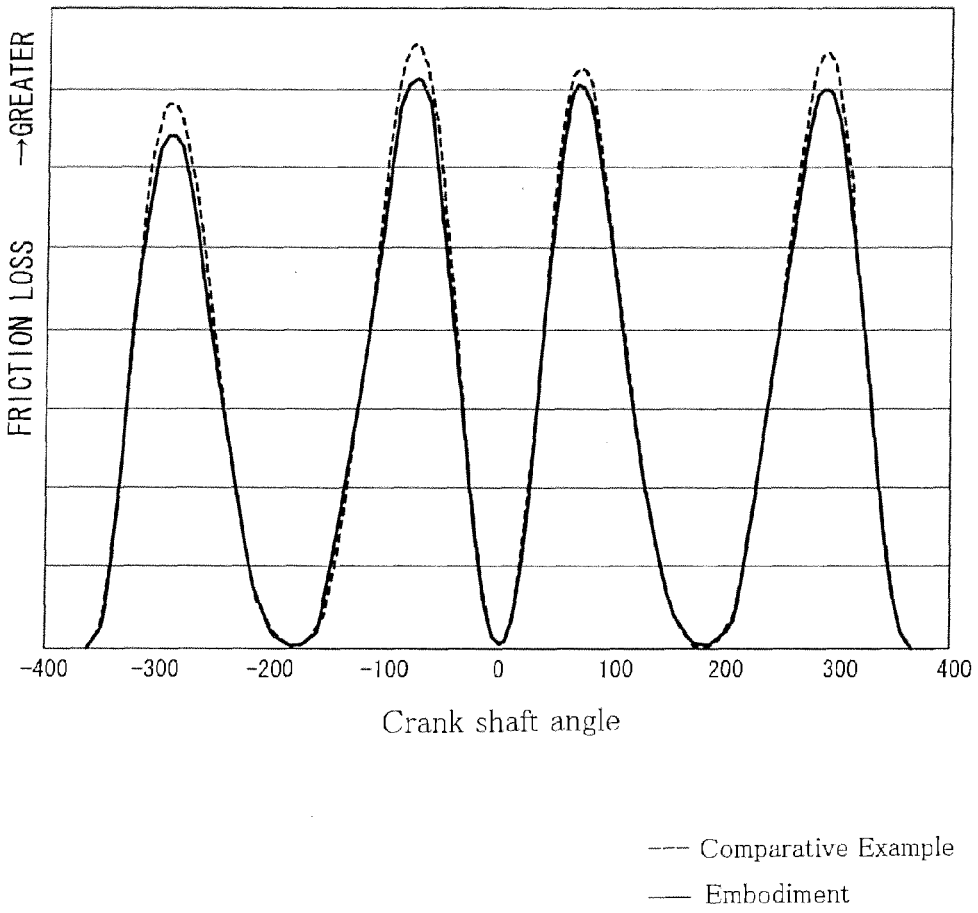
FIG. 11 is a graph illustrating a friction loss of each of the piston of the first embodiment and the piston of earlier technology, which is calculated by numerical analysis.

A graph shown in FIG. 11 shows a friction loss relative to a crankshaft rotational angle which was calculated by numerical analysis, and shows a comparison result between the piston 1 according to this embodiment and the piston of the above-mentioned earlier technology.

As is known from FIG. 11, the friction loss (solid line) of the piston 1 according to this embodiment is lower than the friction loss (dotted line) of the piston of the above-mentioned earlier technology.

From this result, a friction-loss mean effective pressure which is given by dividing the friction loss by an engine stroke volume (displacement) was calculated. The friction-loss mean effective pressure calculated in the case of the piston 1 according to this embodiment is lower by about 5 percent (%) than that in the case of the piston of the above-mentioned earlier technology. That is, the ratio of friction-loss mean effective pressure in this embodiment to friction-loss mean effective pressure in the above-mentioned earlier technology is 0.95 to 1. It shows that the piston 1 according to this embodiment sufficiently reduces the friction.

Each of the bending portions 12 and 13 is not formed over an axial (up-down directional) entirety of the apron portion 5, 6, but is formed only in a region of the apron portion 5, 6 which is located on the side of the crown portion 2. The lower end portion 5*b*, 6*b* of the apron portion 5, 6 is formed in a smooth curvature shape without any bending portion, as mentioned above. Hence, a stiffness of the lower end portion 5*b*, 6*b* is inhibited from becoming excessively low. That is, originally (if it were not for the bending portions 12 and 13), the stiffness of the lower end portion 5*b*, 6*b* of the apron portion 5, 6 is lower than the stiffness of the upper end portion 5*a*, 6*a* because a lower edge of the lower end portion 5*b*, 6*b* is not supported by any member, i.e. in a free state. In this embodiment, the stiffness of the upper end portion 5*a*, 6*a* becomes lower and close to the stiffness of the lower end portion 5*b*, 6*b* because of the provision of the bending portions 12 and 13. Accordingly, the support-stiffness of the apron portion 5, 6 against the skirt portion 3, 4 is substantially even (equalized) over upper and lower parts of the apron portion 5, 6. Therefore, the contact surface pressure of the skirt portion 3, 4 against the cylinder wall surface can be substantially equalized over the entirety of the skirt portion 3, 4.

Moreover, each of the entire apron portions 5 and 6 itself is gently curved. Hence, also the entire apron portion 5, 6 itself causes a slight spring action by its flexible deformation. Therefore, also by this spring action based on the entire shape of the apron portion 5, 6, a contact area between the skirt portion 3, 4 and the cylinder wall surface can become large so that a local surface-pressure increase is suppressed.

That is, both of the skirt portions 3 and 4 and both of the apron portions 5 and 6 cooperate to define a substantially elliptic shape in cross section. Hence, the contact pressure applied to the skirt portion 3, 4 is absorbed by the spring action of the connecting portion 12*c*, 13*c* and the spring action of the entire apron portion 5, 6. Thereby, the surface pressure acting on the skirt portions 3 and 4 is dispersed so that a generation of excessive surface pressure can be suppressed.

As a result, the surface pressure of the skirt portion 3, 4 against the cylinder wall surface is equalized to reduce the contact surface pressure. Therefore, the friction can be effectively reduced.

As another example, the base end portion 12*a*, 13*a* may be set to have a maximum thickness. That is, the connecting portion 12*c*, 13*c* has a thickness smaller than that of the base end portion 12*a*, 13*a*, and the tip portion 12*b*, 13*b* has a thickness further smaller than that of the connecting portion 12*c*, 13*c*. In such a case, the bending portion 12, 13 is deflected (flexibly deformed) more easily by load of the skirt portion 3, 4, so that the contact surface pressure between the cylinder wall surface and the upper end portion of the skirt portion 3, 4 can be further reduced.

As still another example, the two bending portions 12 of the apron portion 5 may be formed left-right-unsymmetrically with respect to the axis P1 of both the pin boss portions 10 and 11 in such a manner that the two bending portions 13 of the apron portion 6 are formed left-right-unsymmetrically with respect to the axis P1 similarly. In this case, designs of the bending portions 12 and the bending portions 13 can be properly changed depending on how the load acts on the piston and/or depending on the thrust side or the counter-thrust side. In consideration of a performance required for the piston, for example, the bending portion 12 and the bending portion 13 may be formed only on the thrust side which receives a load level greater than the counter-thrust side.

Structures according to the present invention are not limited to the above embodiments. For example, existing range and/or axial length of the bending portion 12, 13 of the apron portion 5, 6 can be set at any values depending on specification and size of the piston 1 and the like.

Moreover, for example, the outer circumferential surfaces of the skirt portions 3 and 4 can be coated with a low-friction material which reduces the friction between the cylinder wall surface and the skirt portion 3, 4.

The piston according to the present invention is applicable to various internal combustion engines such as a V-type engine (V-engine), a W-type engine and a single-cylinder-type engine.

Next, some configurations and effects obtainable from the above embodiments according to the present invention will now be listed.

[a] According to the above embodiment, the first slant portions (12*a*, 13*a*) of the pair of apron portions (5, 6) extend such that the first slant portions (12*a*, 13*a*) which face each other and are symmetric with respect to the line perpendicular to the axis of the pin boss portions (10, 11) become closer to each other toward uppermost portions of the first slant portions (12*a*, 13*a*). On the other hand, the second slant portions (12*b*, 13*b*) of the pair of apron portions (5, 6) extend such that the second slant portions (12*b*, 13*b*) which face each other and are symmetric with respect to the line perpendicular to the axis of the pin boss portions (10, 11) become away from each other toward the uppermost portions of the second slant portions (12*b*, 13*b*).

[b] According to the above embodiment, as viewed in cross section, the connecting portion (12*c*, 13*c*) extends along a line slightly slanted from the axis of the pin boss portions (10, 11) in the radially outer direction.

[c] According to the above embodiment, the thickness of the connecting portion (12*c*, 13*c*) is smaller than the thickness of the first slant portion (12*a*, 13*a*), and the thickness of the second slant portion (12*b*, 13*b*) is smaller than the thickness of the connecting portion (12*c*, 13*c*).

Accordingly, the strength is gradually reduced from the first slant portion (12*a*, 13*a*) toward the second slant portion (12*b*, 13*b*) because the thickness is gradually reduced from the first slant portion (12*a*, 13*a*) toward the second slant portion (12*b*, 13*b*). As a result, load applied from the cylinder wall to the respective skirt portions in the thrust and counter-thrust directions can be effectively absorbed.

[d] According to the above embodiment, each of the first slant portion (12*a*, 13*a*) and the second slant portion (12*b*, 13*b*) is smoothly connected with the connecting portion (12*c*, 13*c*) to have a curve-shaped connecting spot therebetween.

Accordingly, each connecting spot is formed to have a smoothly rounded surface. Hence, a concentrated stress is inhibited from acting on the connecting spot. Moreover, a die dividing operation is easy when casting the piston.

[e] According to the above embodiment, the connecting portion (12*c*, 13*c*) extends from a tip of the base end portion (12*a*, 13*a*) in a radially outer direction approximately perpendicular to the extending direction of the base end portion (12*a*, 13*a*), and the tip portion (12*b*, 13*b*) extends from a tip of the connecting portion (12*c*, 13*c*) in a direction toward the circumferential end (3*d*, 3*e*, 4*d*, 4*e*) of the thrust-side or counter-thrust-side skirt portion (3, 4) and approximately perpendicular to the extending direction of the connecting portion (12*c*, 13*c*).

This application is based on prior Japanese Patent Application No. 2014-5524 filed on Jan. 16, 2014. The entire contents of this Japanese Patent Application are hereby incorporated by reference.

The scope of the invention is defined with reference to the following claims.

What is claimed is:

1. A piston of an internal combustion engine, comprising:

a crown portion including a crown surface on which a combustion chamber is formed;

a pair of thrust-side and counter-thrust-side skirt portions each of which is formed integrally with a reverse-surface-side portion of the crown portion and formed in an arc shape in cross section, the thrust-side and counter-thrust-side skirt portions being configured to slide on a wall surface of a cylinder; and a pair of apron portions connecting circumferential both ends of the thrust-side skirt portion with circumferential both ends of the counter-thrust-side skirt portion, the pair of apron portions each including an upper end wall connected with the reverse-surface-side portion of the crown portion, and a pin boss portion supporting an end portion of a piston pin, wherein the reverse-surface-side portion of the crown portion is formed with a hollow portion extending along an outer surface of the upper end wall, wherein the upper end wall of each of the pair of apron portions includes a bending portion between an outside surface of the pin boss portion and one of the circumferential both ends of the thrust-side and counter-thrust-side skirt portions, wherein the bending portion bends in a step-like manner from the outside surface of the pin boss portion toward the one of the circumferential both ends of the thrust-side and counter-thrust-side skirt portions, wherein the bending portion in a transverse cross section of the piston that is perpendicular to a direction of movement of the crown portion in the cylinder includes a base end portion connected with one of both side surfaces of the pin boss portion, a tip portion connected with the one of the circumferential both ends of the thrust-side and counter-thrust-side skirt portions, a connecting portion connecting the base end portion with the tip portion, a first bent portion formed between the base end portion and the connecting portion, and a second bent portion formed between the connecting portion and the tip portion, and wherein a length of the pin boss portion in an axial direction of the pin boss portion is greater than a thickness of the base end portion of the bending portion in the axial direction of the pin boss portion.

2. The piston according to claim 1, wherein the bending portion is substantially in the form of a stepped shape expanded in the step-like manner from the one of both side surfaces of the pin boss portion toward the one of the circumferential both ends of the thrust-side and counter-thrust-side skirt portions.

3. The piston according to claim 2, wherein the base end portions which are connected with the pin boss portions of the pair of apron portions and which face each other in the axial direction of the pin boss portion are inclined to have upper portions closer to each other than lower portions thereof, in a range between the pin boss portion and the connecting portion.

4. The piston according to claim 3, wherein inner and outer surfaces of a connection spot between the base end portion and the connecting portion and inner and outer surfaces of a connection spot between the connecting portion and the tip portion are respectively in an arc shape in cross section.

5. The piston according to claim 3, wherein the connecting portion extends from a tip of the base end portion in an outer direction substantially perpendicular to an extending direction of the base end portion, and the tip portion extends from a tip of the connecting portion in a direction toward the one of the circumferential both ends of the thrust-side and counter-thrust-side skirt portions and substantially perpendicular to an extending direction of the connecting portion.

6. The piston according to claim 2, wherein a lower end portion of each of the pair of apron portions is shaped such that a diameter of the lower end portion is gradually enlarged along an axially lower direction of the piston.

* * * * *